US006260451B1

(12) United States Patent
Mirabito

(10) Patent No.: US 6,260,451 B1
(45) Date of Patent: Jul. 17, 2001

(54) OIL PLUG TOOL

(76) Inventor: Frank D. Mirabito, 77 Alexander Rd., Unit 13, Billerica, MA (US) 01821

( * ) Notice: Subject to any disclaimer, the term of this patent is extended or adjusted under 35 U.S.C. 154(b) by 0 days.

(21) Appl. No.: 09/318,879

(22) Filed: May 26, 1999

(51) Int. Cl.[7] ..... B25B 13/48
(52) U.S. Cl. ..... 81/176.15; 81/177.6
(58) Field of Search ..... 81/177.6, 176.1, 81/176.15, 176.2, 121.1

(56) References Cited

U.S. PATENT DOCUMENTS

| | | | | |
|---|---|---|---|---|
| 151,635 | | 6/1874 | Unlinger et al. . | |
| D. 234,451 | | 3/1975 | Bloom . | |
| 1,270,705 | | 6/1918 | Croad . | |
| 2,423,145 | | 7/1947 | Halm . | |
| 2,796,101 | * | 6/1957 | Hasemann et al. | 81/177.6 |
| 4,252,037 | | 2/1981 | Raine . | |
| 4,351,075 | | 9/1982 | Pittard, Jr. . | |
| 4,794,827 | | 1/1989 | Poling . | |
| 4,982,629 | * | 1/1991 | Germain | 81/176.15 |
| 5,074,173 | | 12/1991 | Cearley . | |
| 5,134,905 | * | 8/1992 | Brennan et al. | 81/124.3 |
| 5,214,985 | | 6/1993 | Rinehart . | |
| 5,277,531 | | 1/1994 | Krivec . | |
| 5,655,280 | | 8/1997 | McCommon . | |
| 5,845,552 | * | 12/1998 | Piascik | 81/176.15 |

* cited by examiner

*Primary Examiner*—Eileen P. Morgan
*Assistant Examiner*—Joni B. Danganan
(74) *Attorney, Agent, or Firm*—O'Connell Law Firm

(57) ABSTRACT

A tool for removing and installing an oil plug of an internal combustion engine comprising a handle, a drive shaft and a tool head. The drive shaft comprises a flexible material suitable for providing improved access to hard to reach oil plugs. The flexibility of the drive shaft also provides a means for limiting torque transmission between the tool and the oil plug, thereby preventing accidental overtightening, and consequent damage to the oil plug. A multitude of tool head designs are also envisioned by the inventor. Each tool head is designed to frictionally engage and retain the oil plug within the tool head during the installation and removal process allowing for easy, single-handed use of the tool during the servicing and repair of an internal combustion engine.

24 Claims, 5 Drawing Sheets

OIL PLUG TOOL

FIELD OF THE INVENTION

The present invention relates generally to tools. Stated more particularly, disclosed herein is a tool for removing and installing an oil plug of an internal combustion engine.

BACKGROUND OF THE INVENTION

Internal combustion engines of the type used to power lawnmowers and the like typically employ motor oil as an internal lubricant. The oil is retained in an oil reservoir that forms a part of the engine body. Typically, the oil reservoir is sealed off from the environment by an oil plug. The plug typically comprises a threaded plastic cap with a set of plastic protrusions extending outwardly therefrom. The protrusions act as a means for enabling an engaging and rotating of the oil plug during installation and removal of the oil plug.

Unfortunately, oil plugs typically are located in close proximity to the main body of what may be a searingly hot engine. Furthermore, oil plugs often are disposed in confined areas of the engine where they are blocked by elements of the engine, by equipment shrouds, and by related structures. As a result, one attempting to manipulate an oil plug, whether during installation or removal, often risks being burned while attempting to remove or install a small, disadvantageously located plug. Yet a further difficulty derives from the fact that an oil plug can require relatively significant torque to remove after being secured in place for an extended period of time during adverse conditions. This undesirable situation can be exacerbated still further when a sticky, oil-covered plug slips from a user's grasp only to fall onto the ground or onto the dirty engine. With this, it becomes clear that manipulating an oil plug can be a cumbersome and frustrating process.

Of course, it is conceivable that one could use a pair of traditional pliers or the like to attempt to remove an oil plug. However, doing so without dropping or damaging the plastic plug is less than simple or convenient. Advantageously, the prior art has disclosed a number of tools designed for removing an oil plug from an internal combustion engine. For example, U.S. Pat. No. 5,214,985 to Rinehart discloses an adapter that attaches to a standard socket wrench. The adapter comprises a disc that has cylindrical female post holders for engaging standard oil plug protrusions in a male-female relationship. Unfortunately, maneuvering a standard socket wrench within the confines typically encountered when working on an internal combustion engine can be a difficult and time-consuming task. Also, tool heads that attach to a standard socket wrench present the user with the disadvantage of accidental overtightening of the oil plug. Since a typical oil plug and the protrusions contained thereon are typically formed from a plastic material, the protrusions are susceptible to being damaged or completely shorn off by overtightening. Obviously, if the protrusions are damaged or shorn off, the task of removing the oil plug becomes complicated, leading to a needless waste of time and energy on the part of the user.

A further prior art device is disclosed in U.S. Pat. No. 4,351,075 to Pittard, Jr. wherein crossed slots engage oil plug protrusions, and still another tool is set forth in U.S. Pat. No. 4,252,037 to Raine wherein the laterally-engaging wrench has a tool head with a series of openings therein for engaging the protrusions on an oil plug. Grooves guide the protrusions into the openings to provide the wrench with a ratchet-like ability. These devices are said to improve a user's ability to remove and tighten an oil plug by improving contact between the tool head and the oil plug. Unfortunately, these prior art inventions each engage oil plugs laterally with a rigid elongate member that does not provide any degree of flexibility or improved access to hard-to-reach oil plugs. Further, with these and similar devices, oil plugs are not retained by the tool head whereby they tend to fall from the tool head once removed from the engine. With this, oil plugs can fall back toward the hot motor and outside the reach of the user.

With these deficiencies in mind, it becomes apparent that an invention would be useful that could present a solution to the problem of accidental overtightening while also providing improved access to hard-to-reach oil plugs. Similarly, a device providing a means for gripping and retaining an oil plug during engine service while further providing improved access to the work area also would be advantageous. With this, it is particularly apparent that an oil plug tool providing a solution to each and every one of the aforementioned problems while providing a number of heretofore-unrealized advantages would represent a marked advance in the art.

SUMMARY OF THE INVENTION

In light of the above-described state of the prior art, a few objects and advantages of the present invention are worth particular mention. For example, it advantageously is a principal object of the present invention to provide an oil plug tool that is particularly adapted for use on internal combustion engines. The invention is also intended to provide rapid and efficient recovery of an oil plug by exhibiting improved frictional contact between the tool head and the protrusions of an oil plug. Another object of the invention is to provide a tool head that decreases the likelihood of premature disengagement of an oil plug from the tool head following extraction of the oil plug from the oil reservoir. The invention also strives to provide an oil plug tool with axial flexibility for providing improved access to difficult-to-reach oil plugs. A further object of the invention is to prevent accidental overtightening of an oil plug. Still further, preferred embodiments of the invention are designed to provide a tool head that can remove oil plugs with protrusions having atypical configurations. Certainly, these and other objects and advantages of the present invention will become obvious to one who reads this specification and reviews the accompanying drawings and to one who has an opportunity to make use of an embodiment of the present invention.

In accomplishing the aforementioned objects, the present invention for an oil plug tool essentially comprises a handle, a drive shaft, and a tool head. The handle is coupled to a first end of the shaft. In preferred embodiments, the handle is crimped to the first end of the shaft. The preferred drive shaft comprises an elongate, axially flexible member, which may comprise an unsupported, bi-directional, helically wound wire shaft. The axial flexibility of the drive shaft facilitates the use of the oil plug tool in situations where one has limited access to an oil plug.

A still more preferable embodiment of the invention will further comprise a means for limiting torque transmission between the tool and an oil plug to be engaged in at least one rotary direction whereby the tool prevents excessive tightening and associated damage to an oil plug to be engaged. Ideally, the means for limiting torque transmission will be bi-directional whereby torque is limited in both rotary directions. Further, the means for limiting torque transmission will prevent torque transmission above a predetermined maximum value beyond which the shaft will experience a torque overload. Where the shaft comprises a helically wound wire shaft, torque overload will produce a kinking of the shaft, which will prevent accidental over-tightening and potential damage to an oil plug.

The tool head is coupled to a second end of the drive shaft, preferably by crimping. Naturally, the tool head can assume a multitude of embodiments. In preferred embodiments, the tool head comprises at least one cavity defined by a first engaging wall with a peripheral surface disposed in opposition to a peripheral surface of a second engaging wall. With this, there may be a single cavity with a first end defined by the peripheral surface of the first engaging wall and a second end defined by the peripheral surface of the second engaging wall. Alternatively, there may be a first cavity defined by the first engaging wall disposed in diametric opposition to a second cavity defined by the second engaging wall. The peripheral surface of each engaging wall acts as a means for engaging and retaining an outer surface of an oil plug protrusion. As will be discussed in more detail below, once the tool head engages an oil plug, the peripheral surfaces of the engaging walls preferably will frictionally engage the outer surfaces of the oil plug protrusions. Accordingly, the distance between the peripheral surfaces of the engaging walls will be dictated by the distance between the outer surfaces of the two protrusions typically found on a standard oil plug.

Where a single cavity is disposed in the tool head, the cavity may assume the shape of a slot. Such a singular cavity may be preferred for its ability to receive oil plug protrusions of standard and non-standard configurations as well as damaged protrusions and protrusions of differing dimensions. For example, the slot-shaped singular cavity would readily engage oil plug protrusions of tab-like and other shapes.

Further, at least a portion of the peripheral surfaces of one or both of the engaging walls may be tapered inwardly from a first end to a second end wherein the first end is proximal to a first surface of the tool head that would be adjacent to an oil plug to be removed and wherein the second end is disposed distal to the first surface. The taper has been found to retain the oil plug more effectively within the tool head during removal and installation thereby enabling one-handed operation of the tool. Advantageously, the more force that is applied to the tool head as it is pressed over the protrusions of the oil plug, the tighter the oil plug will be held within the tool head. Research has shown that the taper will be disposed most preferably at an angle of approximately two degrees.

In one embodiment of the invention where two cavities are employed, the cavities may be annular in cross section and of identical or different effective diameters. For example, the first cavity may have a diameter larger than the diameter of the second cavity and also larger than the diameter of the protrusions of a standard oil plug. The second cavity may be sized to engage a standard oil plug protrusion in a frictional relationship. With this, as the tool head is pressed onto the oil plug, the second cavity will receive and frictionally retain the second oil plug protrusion and retain the oil plug during installation and removal.

One will further appreciate that the handle also can assume a variety of embodiments. For example, the handle can have knurling on its surface to increase the gripping ability of the tool. However, a knurled surface may, under certain circumstances, tend to trap and accumulate dirt on the handle. Therefore, alternatively preferred embodiments have a handle comprising a hexagonal shape with an otherwise smooth surface for easier cleaning of the handle after use.

To remove an oil plug using the present invention, the oil plug tool will first be engaged with an oil plug by causing the protrusions from the oil plug to be received into the cavity or cavities in the tool head of the oil plug tool. With this, the oil plug tool, and thus the oil plug, may be rotated by applying a counter-clockwise rotational torque to the handle of the oil plug tool. As the oil plug is rotated out of threaded engagement with the motor, the oil plug protrusions, which tend to press outwardly upon removal of the oil plug from a motor, will displace outwardly into increased frictional contact with the peripheral surfaces of the engaging walls of the cavity or cavities. This frictional contact advantageously provides a means for securely retaining the oil plug within the tool head even after removal of the oil plug from the engine. This novel aspect of the invention allows for single-handed removal and installation of the oil plug during servicing of the engine.

The foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

Figure 1:
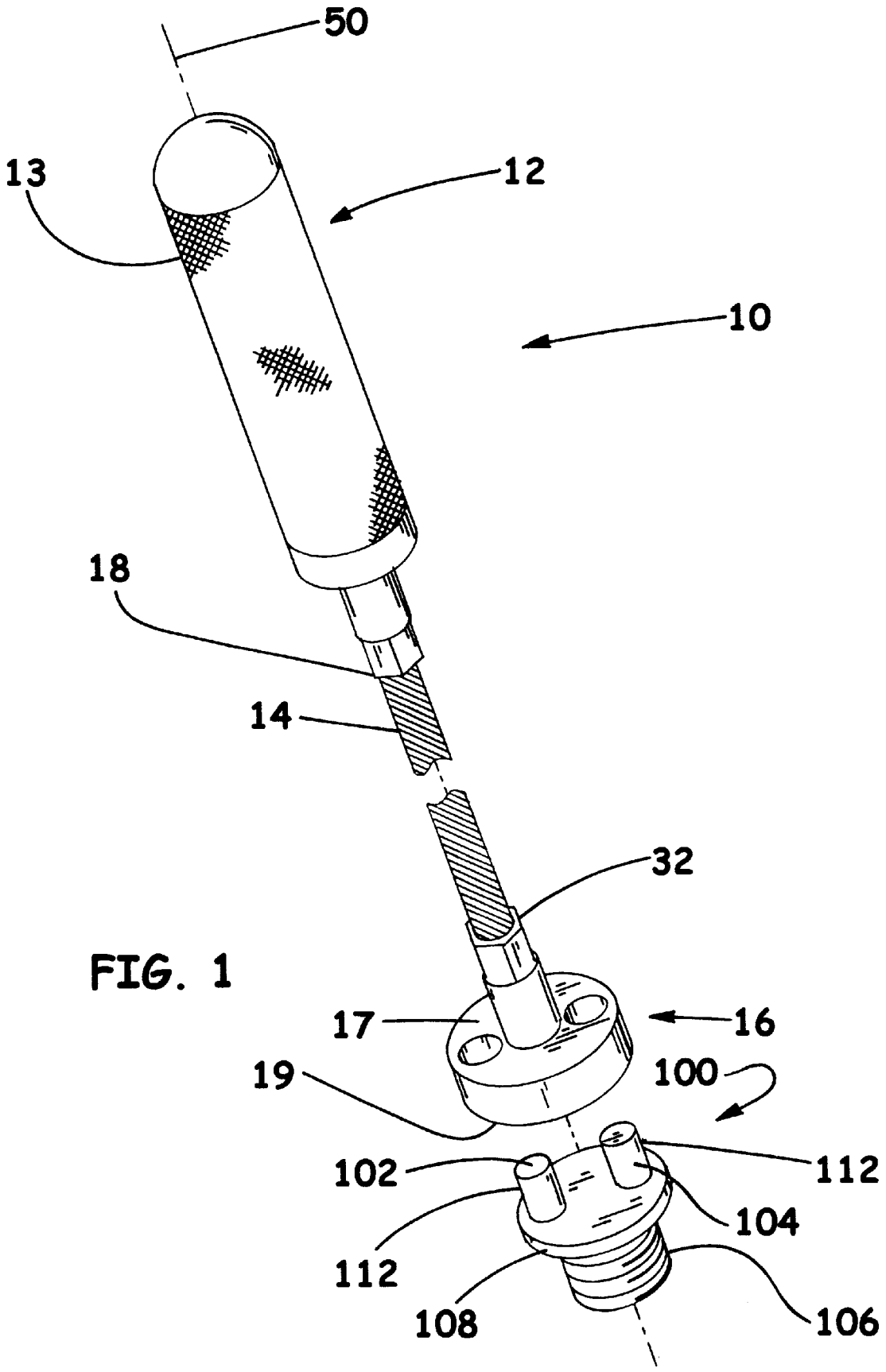
FIG. 1 is a perspective view of an embodiment of the present invention for an oil plug tool.

Looking more particularly to the drawings, a preferred embodiment of the present invention for an oil plug tool is represented generally at 10 in FIG. 1. A handle 12 is coupled to a first end of a drive shaft 14, and a tool head 16 is coupled to a second end of the drive shaft 14. As will be described more fully hereinbelow, the oil plug tool 10 is particularly adapted for engaging an oil plug such as that indicated generally at 100 in FIG. 1. Typically, the oil plug 100 will be employed relative to small internal combustion engines (not shown). As such, the oil plug 100 essentially comprises a cap 108 that has a threaded rod 106 extending from a first side thereof for matingly engaging a correspondingly threaded aperture on an internal combustion engine. First and second protrusions 102 and 104, each with an outer surface 112, extend from a second side of the cap 108 for providing a user with a means for rotating the oil plug 100 during installation and removal. Typically, oil plugs 100 are designed such that the first and second protrusions 102 and 104 tend to bias outwardly as the oil plug 100 is removed from an internal combustion engine and inwardly as the oil plug 100 is reinstalled relative to the engine.

A connection 18 joins the first or proximal end of the drive shaft 14 and the handle 12. In this preferred embodiment, the connection 18 comprises a male element comprising the first end of the drive shaft 14 and a female element comprising an aperture in the handle 12 for receiving the male element. The female element may be crimped about the male element to ensure a fixed coupling between the drive shaft 14 and the handle 12. A substantially similar connection 32 couples a female element of the tool head 16 to a second or distal end of the drive shaft 14.

One should certainly recognize that it is within the scope of the present invention to provide a connection that would allow the handle 12 and the tool head 16 to be disengagably coupled to the shaft 14 thereby allowing the user to interchange handles or tool heads. Furthermore, one will appreciate that the handle 12 may be formed from a variety of materials. For example, in FIG. 1, the handle 12 is round in cross section and has a knurled surface 13. Of course, the handle 12 need not be knurled and could assume a variety of shapes. For example, as FIG. 2 shows, the handle 12 alternatively could be hexagonal in cross section, which could ensure proper grip thereby eliminating any need for knurling.

Figure 2:
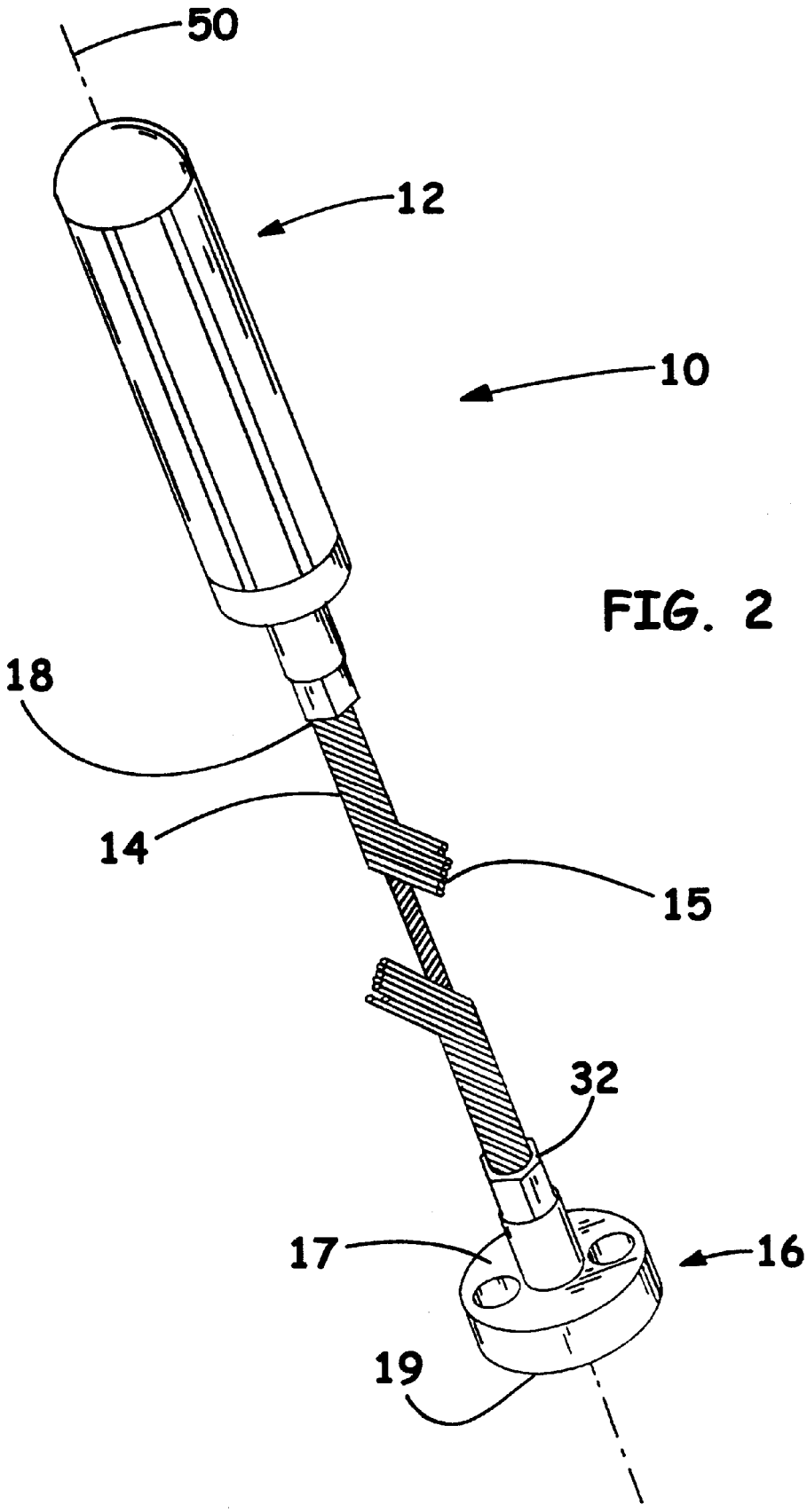
FIG. 2 is a perspective view of an alternative embodiment of the invention wherein the drive shaft is partially dissected.

Looking now to FIG. 2, one sees a slightly alternative embodiment of the invention wherein the drive shaft 14 is shown partly dissected for greatest clarity. As FIG. 2 shows, the drive shaft 14 comprises an unsupported bi-directional, helically wound flexible wire 15. Advantageously, the helically wound wire 15 provides the drive shaft 14 with axial flexibility such that it can bend along its length to allow the oil plug tool 10 to provide access to otherwise inaccessible, possibly confined, spaces. The astute observer will realize that the orientation of at least the distal end of the drive shaft 14 relative to the tool head 16 and, thus, the oil plug 100 causes the oil plug tool 10 and the oil plug 100 to share a common axis of rotation 50. The oil plug tool 10 thereby allows still greater operability in the confined spaces that are inherent with small internal combustion engines.

The skilled artisan will appreciate that this arrangement comprises a marked improvement over prior art devices that commonly engage oil plugs 100 from a lateral direction since swinging such prior art tools laterally in confined engine areas may be difficult or impossible due to obstructions presented by elements of the engine, equipment shrouds, or other environmental structures.

The bi-directional, helically wound wire 15 of the drive shaft 14 advantageously provides substantially equal amounts of rotary torque in clockwise and counterclockwise directions. In a preferred embodiment, the bi-directional helically wound wire 15 of the drive shaft 14 is unsupported in the sense that it has no casing and comprises a means for limiting torque transmission between the tool and an oil plug. With this, any force applied beyond a pre-determined maximum value results in a torque overload and a consequent kinking of the helically wound wire 15 of the drive shaft 14 thereby preventing accidental overtightening and inevitable damage to the oil plug 100. The inventor has discovered that the maximum torque value should not exceed approximately thirty pounds per inch while twenty-five pounds per inch is preferred. To achieve these ratings, the ideal drive shaft 14 will have an unsupported length of not greater than approximately four inches and a diameter of not greater than approximately one-quarter inches.

Figure 3:
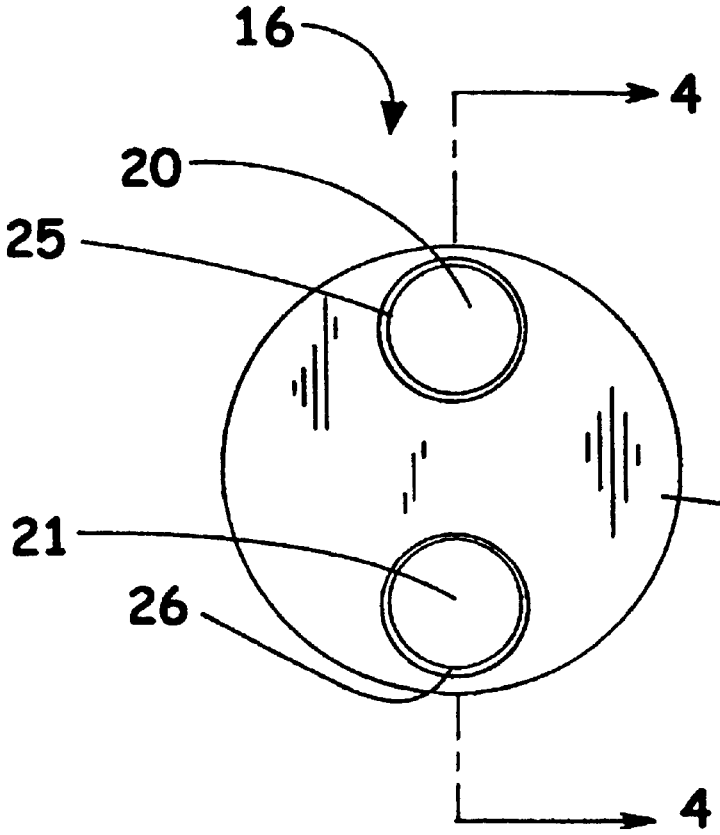
FIG. 3 is a bottom plan view of a tool head according to the present invention.
Figure 4:
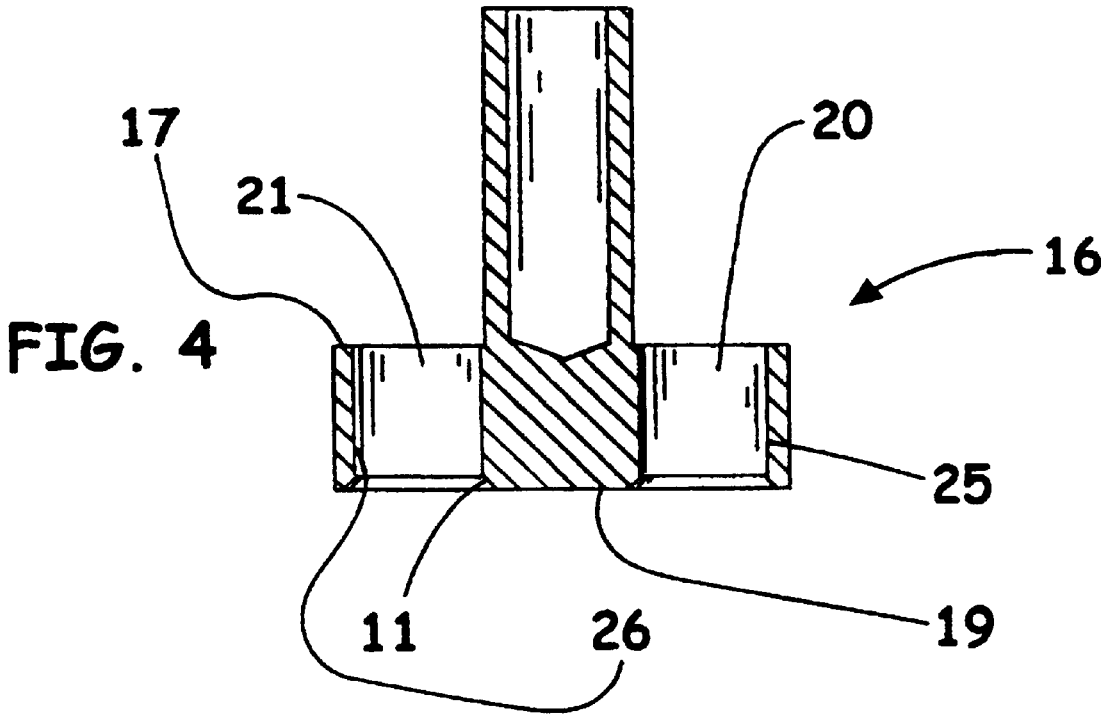
FIG. 4 is a sectional view in front elevation of the tool head of FIG. 3.

Looking next to FIG. 3, one sees a preferred embodiment of the tool head 16. FIG. 4 shows the same tool head 16 in a sectioned front elevational view. A first cavity 20 and a second cavity 21, each comprising a bored hole, are diametrically spaced in opposition in the tool head 16 for providing precise engagement with the first and second protrusions 102 and 104 of the oil plug 100. To allow most ready engagement with the first and second protrusions 102 and 104, each of the first and second cavities 20 and 21 has a bevel 11. The first and second cavities 20 and 21 extend entirely through the tool head 16 for allowing any debris that may be disposed on the first and second protrusions 102 and 104 to pass therethrough and not be trapped. The first cavity 20 comprises a first engaging wall 25 with a peripheral surface for being disposed adjacent to the outer surface 112 of the first protrusion 102 and the second cavity 21 comprises a second engaging wall 26 with a peripheral surface for being disposed adjacent to the outer surface 112 of the second protrusion 104. The peripheral surface of each engaging wall 25 and 26 has a first end proximal to a first surface 19 of the tool head 16 and a second end distal to the first surface 19 of the tool head 16. The dimensions of the oil plug tool 10 certainly will vary depending on the oil plug 100 to be engaged. In one preferred embodiment of this type, however, the first and second cavities 20 and 21 will have equal diameters of approximately 0.323 inches with the peripheral surfaces of the first and second engaging walls 25 and 26 spaced approximately 0.975 inches. The bevel will be cut at approximately a thirty degree angle relative to axes of the first and second cavities 20 and 21.

Figure 5:
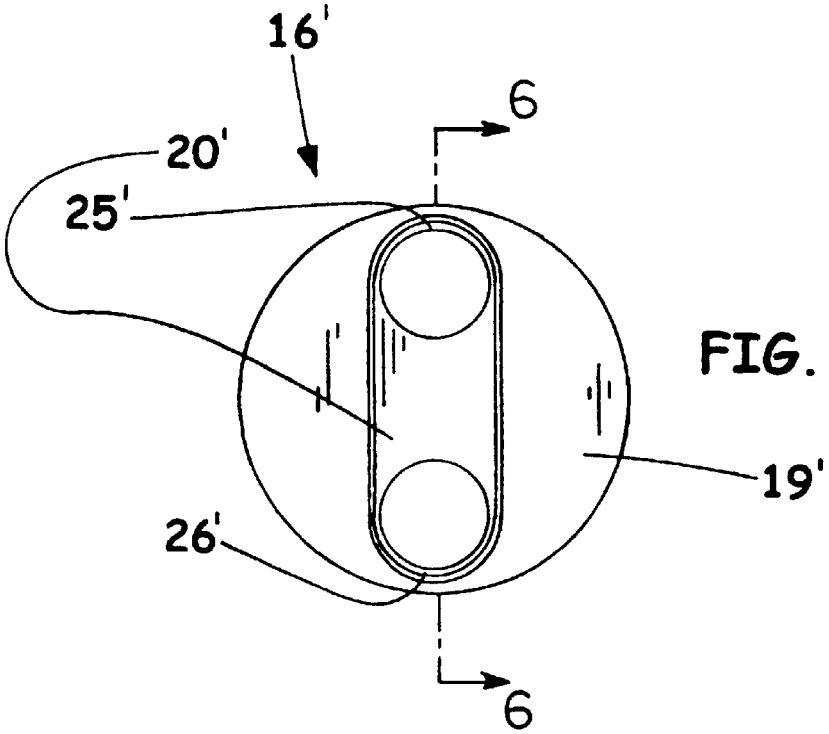
FIG. 5 is bottom plan view of an alternative tool head.
Figure 6:
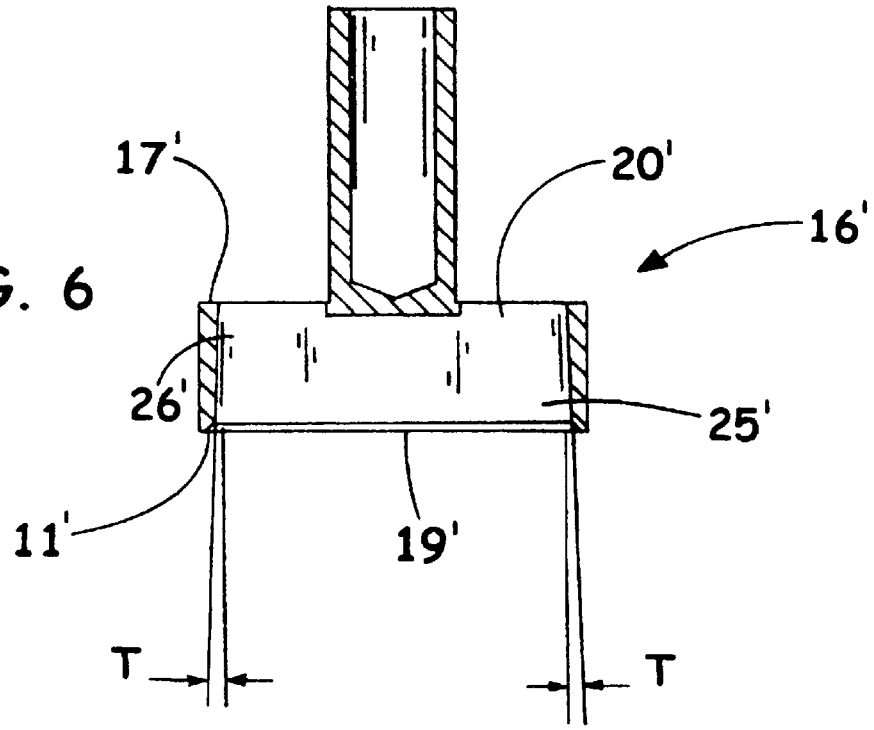
FIG. 6 is a sectional view in front elevation of the tool head of FIG. 5.

FIG. 5 discloses an alternative embodiment of the tool head, and FIG. 6 is a sectional view of the same embodiment in front elevation. In this embodiment, there is only a first cavity 20', which in this case comprises a machined slot that is defined by the first engaging wall 25' and the second engaging wall 26'. By virtue of its slot-like configuration, the first cavity 20' can receive oil plugs 100 with either typical protrusions or tab-like protrusions. Again, each of the engaging walls 25' and 26' has a first end disposed proximate to the first surface 19' of the tool head 16' and a second end disposed distal to the first surface 19' of the tool head body 16'. In this embodiment, however, the peripheral surface of the first engaging wall 25' is tapered inwardly at a taper T from the first end of the first engaging wall 25' to the second end of the first engaging wall 25'. In most preferred embodiments the taper T is disposed at an angle of approximately two degrees. One will note that through holes extend through the slot-like configuration of the first cavity 20' to allow debris to pass therethrough. Again, the dimensions of the oil plug tool 10 will necessarily be dependent on the oil plug 100 to be engaged. However, in this embodiment, the peripheral surfaces of the first and second engaging walls 25' and 26' are spaced approximately 0.975 inches apart and the first cavity 20' has a width of approximately 0.323 inches. A bevel 11' is again provided.

With this, as the first surface 19 of the tool head body 16 is pressed onto the oil plug protrusions 102 and 104 and the oil plug 100 is removed from the internal combustion engine, the tapered peripheral surface of the first engaging wall 25 frictionally and mechanically engages and retains the protrusions 102 and 104 of the oil plug 100. Consequently, once the oil plug 100 is removed from the engine, the first cavity 20' frictionally retains the oil plug 100 in the tool head body 16' thereby allowing single-handed removal and installation procedures and preventing the oil plug 100 from falling to the ground or into the vicinity of the potentially hot engine.

Figure 7:
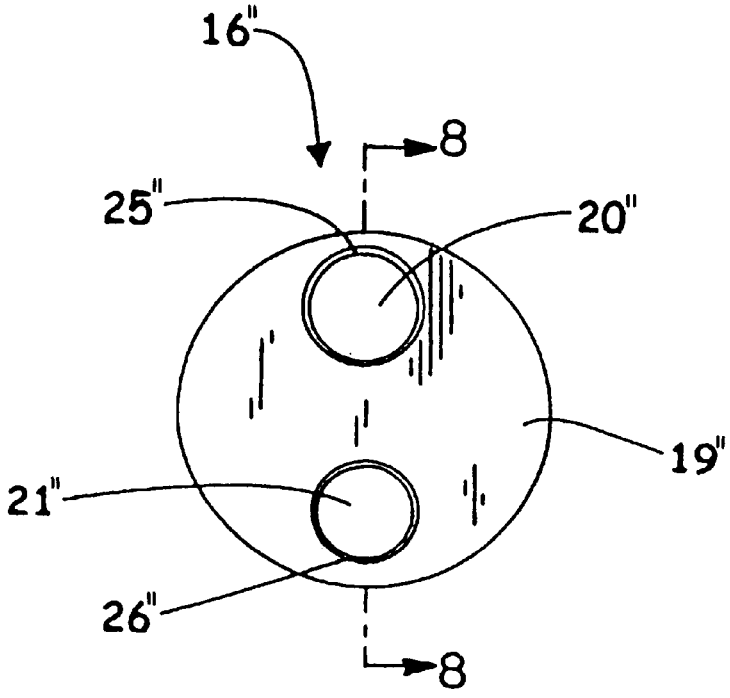
FIG. 7 is bottom plan view of another alternative tool head.
Figure 8:
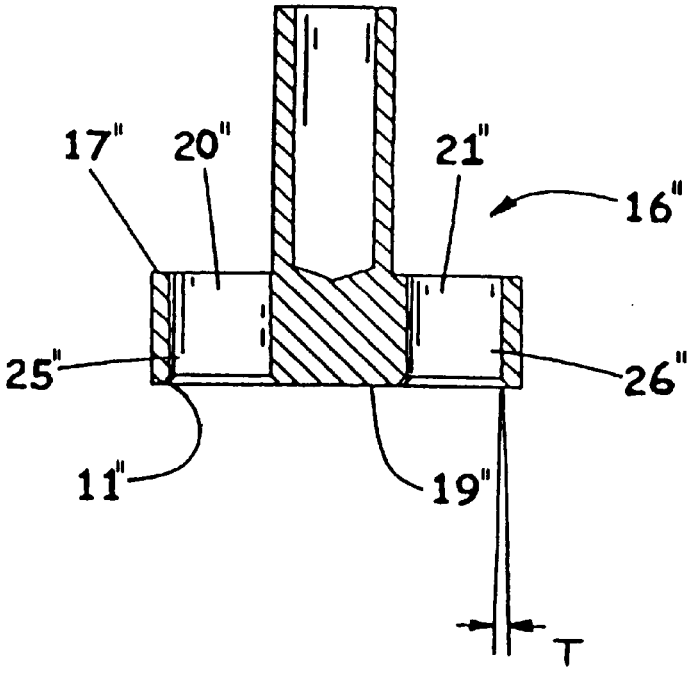
FIG. 8 is a sectional view in front elevation of the tool head of FIG. 7.

FIG. 7 discloses yet another embodiment of the tool head 16". Again, the first and second cavities 20" and 21" are advantageously spaced at a predetermined distance to engage the first and second protrusions 102 and 104 of a standard oil plug 100. In this embodiment, however, the first cavity 20" is of a greater diameter than the second cavity 21" to allow an engaging of damaged or varied oil plugs 100. Although the dimensions of the first and second cavities 20" and 21" again will vary, in this embodiment the first cavity 20" has a diameter of approximately 0.38 inches, and the second cavity 21" has a diameter of approximately 0.323 inches. The smaller second cavity 21" frictionally engages and retains the second protrusion 104 of the oil plug 100. As FIG. 8 shows most clearly, the smaller second cavity 21" is tapered inwardly at a taper T, which is preferably approximately two degrees, from the first end of the second engaging wall 26" to the second end of the second engaging wall 26".

One will note that each of the embodiments of the present invention set forth above advantageously exploits the tendency of the first and second protrusions 102 and 104 of the oil plug 100 to bias outwardly as the oil plug 100 is removed from an internal combustion engine and inwardly as the oil plug 100 is reinstalled relative to the engine to ensure that there is frictional contact between the first and second protrusions 102 and 104 of the oil plug 100 when the oil plug 100 is removed from an engine and further to ensure that the oil plug tool 10 is readily removable from the oil plug 100 when the oil plug is reinstalled in an engine. By doing so, the oil plug tool 10 enables reliable and convenient, one-handed operation throughout the removal and installation processes.

From the foregoing, it will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventor, and the claims shall be deemed to include equivalent constructions insofar as they do not depart from the spirit and scope of the present invention. A plurality of the following claims express certain elements as a means for performing a specific function, at times without the recital of structure or material. As the law demands, these claims shall be construed to cover not only the corresponding structure and material expressly described in the specification but also equivalents thereof.

What is claimed is:

1. A tool for engaging an oil plug of an internal combustion engine, the tool comprising:

a drive shaft with a first end and a second end;

a handle coupled to the first end of the drive shaft; and a tool head coupled to the second end of the drive shaft wherein the tool head comprises first and second cavities extending entirely through the tool head for engaging an oil plug without trapping debris within the tool head.

2. The tool for engaging an oil plug of claim 1 wherein the tool head further comprises a means for frictionally engaging an oil plug whereby the tool head frictionally retains an oil plug that has been removed from an internal combustion engine.

3. The tool for engaging an oil plug of claim 2 wherein the means for frictionally engaging an oil plug comprises at least one cavity with a first engaging wall with a peripheral surface for frictionally engaging an outer surface of a first protrusion of an oil plug and a second engaging wall with a peripheral surface for frictionally engaging an outer surface of a second protrusion of an oil plug.

4. The tool for engaging an oil plug of claim 1 wherein the drive shaft comprises a flexible shaft whereby the drive shaft enables access to otherwise inaccessible oil plugs.

5. The tool for engaging an oil plug of claim 4 wherein the driveshaft comprises a helically wound wire flexible shaft.

6. The tool for engaging an oil plug of claim 5 wherein the drive shaft comprises a bi-directional helically wound wire flexible shaft whereby the drive shaft is capable of providing substantially equal amounts of rotary torque in clockwise and counter-clockwise rotary directions.

7. The tool for engaging an oil plug of claim 6 wherein the drive shaft is unsupported.

8. The tool for engaging an oil plug of claim 1 further comprising a means for limiting torque transmission between the tool and an oil plug to be engaged whereby the tool prevents excessive tightening and associated damage to an oil plug to be engaged.

9. The tool for engaging an oil plug of claim 8 wherein the means for limiting torque transmission between the tool and an oil plug to be engaged comprises a helically wound wire flexible shaft calibrated to prevent torque transmission beyond a predetermined maximum value.

10. The tool for engaging an oil plug of claim 9 wherein the helically wound wire flexible shaft is calibrated to prevent torque transmission beyond 30 pounds per inch.

11. The tool for engaging an oil plug of claim 10 wherein the helically wound wire flexible shaft has an overall length of not greater than four inches.

12. The tool for engaging an oil plug of claim 11 wherein the helically wound shaft has a diameter not greater than one-quarter inches.

13. The tool for engaging an oil plug of claim 1 wherein the handle has a knurled surface and the tool head has a first surface with a means for frictionally engaging and retaining an outer surface of an oil plug protrusion and a second surface with a means for connecting the tool head to a rotatable power source.

14. The tool for engaging an oil plug of claim 1 wherein the handle has a round cross section and the tool head has a first surface with a means for frictionally engaging and retaining an outer surface of an oil plug protrusion and a second surface with a means for connecting the tool head to a rotatable power source.

15. The tool for engaging an oil plug of claim 1 wherein the handle has a hexagonal cross section and the tool head has a first surface with a means for frictionally engaging and retaining an outer surface of an oil plug protrusion and a second surface with a means for connecting the tool head to a rotatable power source.

16. The tool for engaging an oil plug of claim 1 wherein the tool head and at least the second end of the drive shaft share a common axis of rotation.

17. A tool head for engaging an oil plug that has a main body with at least one protrusion extending therefrom, the tool head comprising a first surface with at least one cavity disposed entirely through the tool head with a means for frictionally engaging and retaining an outer surface of an oil plug protrusion and a second surface with a means for connecting the tool head to a rotatable power source.

18. The tool head of claim 17 wherein the means for frictionally engaging and retaining an oil plug protrusion comprises at least a first cavity defined by a first engaging wall with a peripheral surface and a second engaging wall with a peripheral surface wherein each peripheral surface is adapted for frictionally engaging an outer surface of a protrusion from an oil plug and wherein each engaging wall has a first end proximal to the first surface of the tool head and a second end distal to the first surface of the tool head.

19. The tool head of claim 18 further comprising a second cavity wherein the first cavity is defined by the first engaging wall and the second cavity is defined by the second engaging wall.

20. The tool head of claim 17 wherein the means for frictionally engaging and retaining an oil plug protrusion consists of the first cavity that is defined by the first engaging wall and the second engaging wall.

21. A tool head for engaging an oil plug that has a main body with at least one protrusion extending therefrom, the tool head comprising;

a first surface with a means for frictionally engaging and retaining an outer surface of an oil plug protrusion, and a second surface with a means for connecting the tool head to a rotatable power source;

wherein the means for frictionally engaging and retaining an oil plug protrusion comprises at least a first cavity defined by a first engaging wall with a peripheral surface and a second engaging wall with a peripheral surface wherein each peripheral surface is adapted for frictionally engaging an outer surface of a protrusion from an oil plug and wherein each engaging wall has a first end proximal to the first surface of the tool head and a second end distal to the first surface of the tool head; and wherein at least a portion of the peripheral surface of at least the first engaging wall is tapered inwardly from the first end of the first engaging wall to the second end of the first engaging wall.

22. The tool head of claim 21 wherein the taper is disposed at an angle of approximately two degrees.

23. A tool head for engaging an oil plug that has a main body with at least one protrusion extending therefrom, the tool head comprising;

a first surface with a means for frictionally engaging and retaining an outer surface of an oil plug protrusion and a second surface with a means for connecting tool head to a rotatable power source;

wherein the means for frictionally engaging and retaining an oil plug protrusion comprises a first cavity and a second cavity wherein the first cavity is defined by a first engaging wall with a peripheral surface and wherein the second cavity is defined by a second engaging wall with a peripheral surface wherein each peripheral surface is adapted for frictionally engaging an outer surface of a protrusion from an oil plug and wherein each engaging wall has a first end proximal to the first surface of the tool head and a second end distal to the first surface of the tool head; and wherein the first cavity has a diameter larger than a diameter of the second cavity.

24. The tool head of claim 23 wherein at least a portion of the peripheral surface of at least the first engaging wall is tapered inwardly from the first end of the first engaging wall to the second end of the first engaging wall.

* * * * *